United States Patent [19]

Cook et al.

[11] 4,113,586

[45] Sep. 12, 1978

[54] METHOD AND APPARATUS FOR THE ELECTROLYTIC RECOVERY OF METAL EMPLOYING ELECTROLYTE CONVECTION

[75] Inventors: Glenn Cook, Harvard; Paul Larson, Peabody, both of Mass.

[73] Assignee: Kennecott Copper Corporation, New York, N.Y.

[21] Appl. No.: 845,128

[22] Filed: Oct. 25, 1977

[51] Int. Cl.[2] ..... C25C 1/00; C25C 7/00

[52] U.S. Cl. ..... 204/105 R; 204/273; 204/277; 204/297 R

[58] Field of Search ..... 204/277, 297 R, 297 W, 204/273, 105 R

[56] References Cited

U.S. PATENT DOCUMENTS

| | | | |
|---|---|---|---|
| 1,365,034 | 1/1921 | Greenawalt | 204/277 X |
| 1,704,247 | 3/1929 | Harrison | 204/277 X |
| 3,259,049 | 7/1966 | Ulthoven | 204/277 X |
| 3,898,150 | 8/1975 | Russell et al. | 204/297 R X |

*Primary Examiner*—John H. Mack
*Assistant Examiner*—D. R. Valentine
*Attorney, Agent, or Firm*—John L. Sniado; Anthony M. Lorusso

[57] ABSTRACT

Apparatus and methods for the recovery of metal values from an electrolyte in an electrodeposition or electrowinning cell are disclosed. A bottom baffle assembly supporting a plurality of bubble tubes and alignment devices is urged upward from the bottom of the electrolytic cell. An electrode assembly, having alignment means which cooperate with the alignment devices on the bottom baffle assembly, engages and aligns with the bottom baffle assembly when the electrode assembly is lowered into the electrolyte. Thereby, the bubble tubes are aligned to provide sheets of bubbles between the anode and cathode faces. The invention also features methods and apparatus for separating the electrodes, after the electrodeposition or electrowinning process, by pulling them apart in the horizontal direction to minimize the chance of damage to the electrodes.

22 Claims, 6 Drawing Figures

METHOD AND APPARATUS FOR THE ELECTROLYTIC RECOVERY OF METAL EMPLOYING ELECTROLYTE CONVECTION

This invention relates to methods and apparatus for electrodepositing metal and in particular to electrolytic methods and apparatus for recovering copper.

BACKGROUND OF THE INVENTION

As the demand for metals continues to grow and as the availability of high-grade deposits decreases, research studies continue to provide better and less expensive apparatus and methods for recovering metal values from low-grade mineral deposits.

One example of a successful apparatus and method is Harvey et al, U.S. Pat. Nos. 3,875,041, issued Apr. 1, 1975, and 3,928,152, issued Dec. 23, 1975, both of which are assigned to the assignee of this application. Harvey et al describe apparatus and methods for improving the electrolytic recovery of metal employing electrolyte convection. The apparatus and methods described in the Harvey et al patents increase the rate at which metal values are deposited, by carefully controlling the process parameters and the interelectrode structure of the electrolytic cell. The result is a lower cost per pound of recovered metal.

Apparatus and methods disclosed in the Harvey et al patents, which are hereby incorporated by reference, require careful control of the distance between the cathode and anode faces, the use of sheets of gas bubbles to maintain agitation and convective motion of the electrolyte, and the use of baffles to control the flow of electrical currents through the electrolyte and hence to control the deposition of metals onto the cathodes.

However, the apparatus and methods described and claimed in the Harvey et al patents result primarily from work performed in a laboratory environment and hence the apparatus and methods are not necessarily carefully tailored to a commercial manufacturing environment.

It is therefore a principal object of the invention to provide apparatus and methods more suited to commercial practice than those disclosed by Harvey et al. Other objects of the invention include providing apparatus and methods which are rugged, reliable, simple to construct and implement, and inexpensive to use. Yet other objects of the invention include providing apparatus and methods which increase the speed at which metal values may be stripped from the cathode members according to the apparatus and methods of the Harvey et al patents and which provide higher metal output than presently used commercial processes. A further object of the invention is to improve and simplify cell loading and unloading to avoid damage to the anodes and cathodes.

SUMMARY OF THE INVENTION

The apparatus and method of the invention relate to electrodeposition and electrowinning for depositing metal values from an electrolyte containing cell. The electrodeposition or electrowinning cell generally comprises a plurality of anodes and cathodes spaced apart in an interleaved configuration for submergence in the electrolyte. Non-conductive anode bottom extensions are positioned beneath the anodes, and non-conductive convection edge baffles are positioned adjacent to opposite vertical edges of the anode faces and extend toward the cathode faces. The cathodes are closely spaced apart from the anodes, the submerged length of the cathodes being greater than the submerged length of the anodes. The cathodes are wider than the anodes so that the vertical edge portions of the cathodes extend outwardly beyond the convection baffles. Means are provided for maintaining the close spacing between the anode and cathode faces. Bubble tubes, having orifices for generating sheets of relatively small, rapidly ascending bubbles of gas that result in agitation of the electrolyte over the cathode faces are also provided. The portion of each bubble tube having the orifices is positioned to provide the sheets of bubbles between the non-conductive anode extensions and the cathode faces.

The baffles form enclosures between the cathode and anode faces which minimize lateral spreading and contraction of the sheets of bubbles and prevent deposition of metal at the edge portions of the cathodes extending beyond the baffles. The anode bottom extensions, in combination with the submerged length of the cathodes, prevent deposition of metal at the bottom edge portions of the cathode faces.

The cells according to the invention feature a bottom baffle assembly having a tube support assembly for positioning the bubble tubes in a spaced apart relationship, the tube support assembly and the bubble tubes together forming an integral structure. Means are provided for urging the baffle assembly to a position near the electrolyte surface. In a particular preferred embodiment, the bottom baffle assembly has a net positive buoyancy, at least when the bubble tubes are filled with gas. At least one flexible conduit is provided to supply gas to the bubble tubes. An electrode assembly comprising the anodes and cathodes, further has an electrode baffle assembly means for engaging the baffle assembly, for aligning the electrode assembly and the baffle assembly, and for maintaining the baffle assembly in a submerged state when the anodes and cathodes are submerged. Thereby, when the anodes and cathodes are removed, as a unit, from the electrodeposition or electrowinning cell, the bottom baffle assembly rises from the submerged state to an alignment state near the top of the electrolytic solution.

In preferred embodiments, the electrode baffle means includes the edge baffles and a position alignment device integral with the edge baffles. The bottom baffle assembly further comprises a cooperating positioning means integral with the baffle assembly for receiving the position alignment device. Thereby, when the unitary electrode assembly is placed into the cell, the position alignment device engages the cooperating positioning means to provide a selected, spaced apart, aligned relationship between the anode and cathode faces, on the one hand, and the bubble tubes on the other hand. The bottom baffle assembly is then urged by the electrode assembly into the submerged state.

In another aspect of the invention, the cell further features a bottom baffle assembly which includes the anode bottom extensions. The positioning means has a plurality of locating wedges, each wedge formed at a top edge portion of an anode extension and protruding at least slightly above the surface of the electrolyte when the bottom baffle assembly is in the alignment state. The position alignment device has a plurality of fork shaped wedge receiving members, each member being integral with and forming the bottom portion of an edge baffle.

Preferably, the bottom baffle assembly further has at least one flotation tank for providing positive buoyancy to the assembly.

The method of performing electrodeposition or electrowinning of metal at a high ratio of current density to metal ion concentration, in a cell which includes anodes, cathodes, and an electrolyte, with the attendent production of high quality metal which can be easily stripped from the cathodes features the steps of positioning non-conductive convection edge baffles adjacent to opposite edges of the anode faces so as to extend toward the cathode faces; providing cathodes that extend downwardly to a level below the bottom edge of the anodes and which are wider than the anodes so that the edges of the cathodes extend outwardly beyond the convection edge baffles; and assembling the cathodes, anodes, and edge baffles together to form an electrode assembly of interleaved cathodes and anodes wherein the opposed cathode and anode faces are spaced apart from each other at a distance less than about two inches. The method further features the steps of providing a bottom baffle assembly having bubble tubes spaced apart in an integral relationship thereto, to mate and align with the electrode assembly; providing an upward force, acting on the bottom baffle assembly, urging the assembly to rise to an alignment state near the top of the electrolyte; aligning the electrode assembly, having its interleaved cathodes and anodes, with the baffle assembly as the electrode assembly is placed, as a unitary structure, into the electrolyte; and submerging the electrode assembly below the surface of the electrolyte whereby the bottom baffle assembly is submerged and the bubble tubes are positionally aligned with the non-conductive anode extensions and the cathode faces; and the non-conductive anode bottom extensions are positioned beneath the anodes. The method further features the steps of supplying gas to the bubble tubes through at least one flexible conduit; and electrodepositing metal on the cathodes while generating sheets of gas bubbles from the bubble tubes, each sheet passing through the electrolyte between opposed anode-cathode faces to produce agitation of the electrolyte over the cathode faces as metal is being deposited thereon. The convection edge baffles are maintained during electrodeposition to form enclosures between the anode and cathode faces to minimize lateral spreading and contraction of the sheets of bubbles and to prevent deposition of metal at the edges of the cathodes extending beyond the baffles. Electrodeposition on the bottom of the cathode faces is prevented by the combination of the submerged length of the cathodes and the anode bottom extensions.

In preferred embodiments of the invention, the method features the steps of lifting the electrode assembly, including the cathodes and the anodes, as a unitary structure from the electrolyte solution; allowing the bottom baffle assembly to rise to a position near the electrolyte surface when the electrode assembly is removed from the electrolyte, at which position a portion of the bottom baffle assembly extends above the upper surface of the electrolyte; and providing cooperating alignment aids on the bottom baffle assembly and the electrode assembly to align the assemblies during a following reinsertion step. The preferred method further features the steps of separating the cathodes and the anodes from each other; removing deposited metal values from the cathode faces; reassembling the cathodes and anodes to form the electrode assembly; and reinserting the reassembled electrode assembly, as a unitary structure, into the electrolyte in alignment with the bottom baffle assembly.

In a particularly preferred embodiment, the separating step features the step of horizontally separating the anodes and cathodes along an axis normal to their faces, whereby the physical integrity of the anodes and cathodes is maintained and the electrodes are less likely to become damaged.

DESCRIPTION OF THE DRAWINGS

These and other objects, features, and advantages of the invention will appear from the following description of a preferred embodiment of the invention taken together with the attached drawings in which.

DESCRIPTION OF PARTICULAR PREFERRED EMBODIMENTS

General Description

Figure 1:
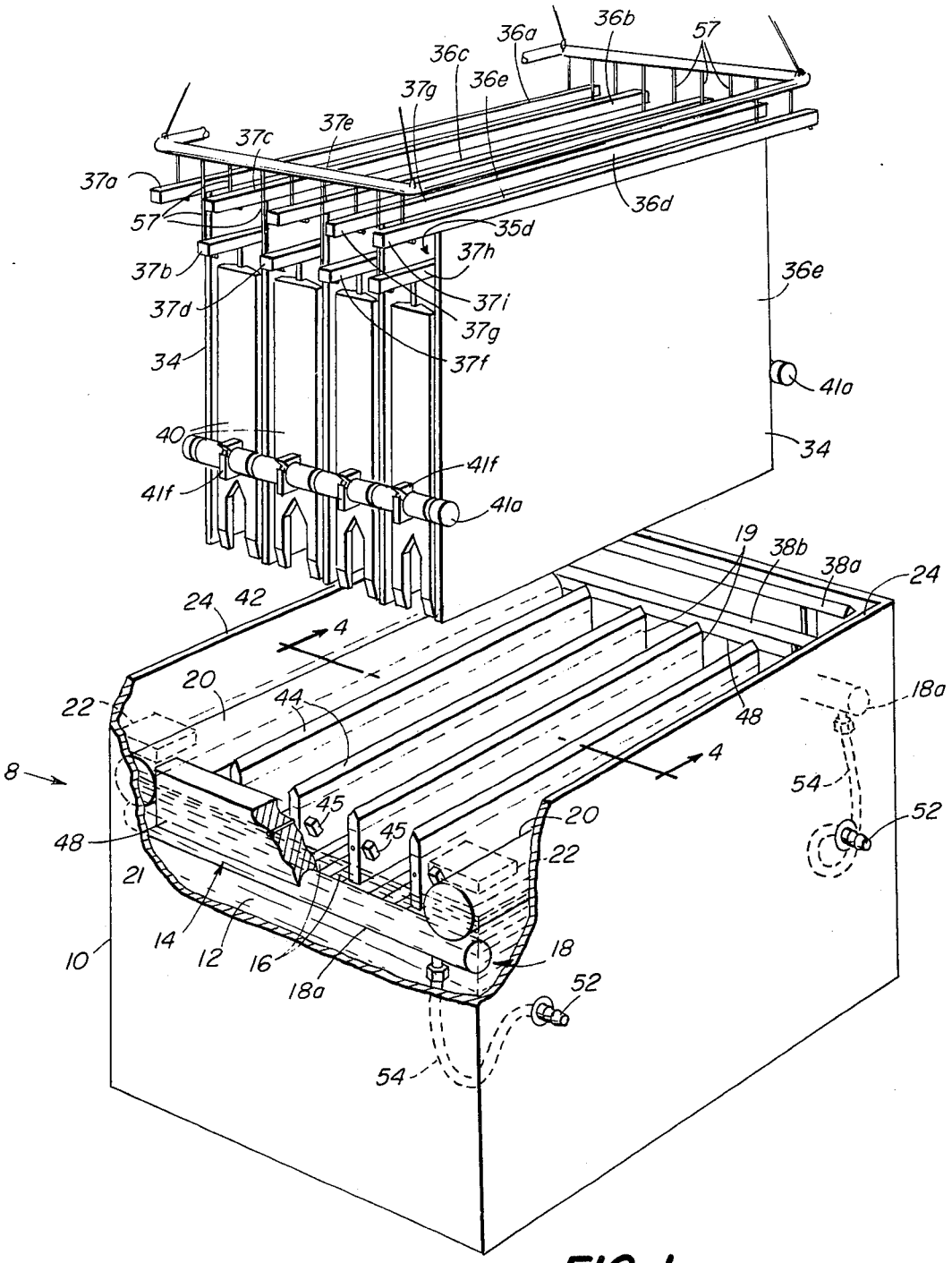
FIG. 1 is a perspective view of a typical electrodeposition cell showing the bottom baffle assembly in its alignment state near the top of the electrolyte and with the electrode assembly about to be inserted into the cell.

Referring to FIG. 1, an electrodeposition cell 8 for depositing metal values from a metal ion containing electrolyte onto metal electrodes comprises a substantially rectangular shaped vessel 10 containing an electrolytic solution 12. The vessel contains a bottom baffle assembly 14, which is an integrated structure comprising, in the illustrated embodiment, a plurality of spaced apart bubble tubes 16 supported by a bubble tube support assembly 18 (assembly 18 including at least gas manifolds **18*a*), a plurality of spaced apart bottom baffles or anode extensions 19, and flotation tanks 20. The illustrated bottom baffle assembly, at least when the bubble tubes are filled with gas (preferably water saturated air), has a net positive buoyancy; and in the absence of restraining forces, the bottom baffle assembly will rise, as illustrated, toward a top surface 21 of the electrolytic solution 12. (Other means, such as a mechanical spring force, can be used to urge the bottom baffle assembly upwards.) The bottom baffle assembly can be restrained, if necessary, in its upward movement by a plurality of interfering, horizontally positioned, stop members which may be, for example, flat plates 22 secured to the side walls 24 of cell 10**.

Figure 2:
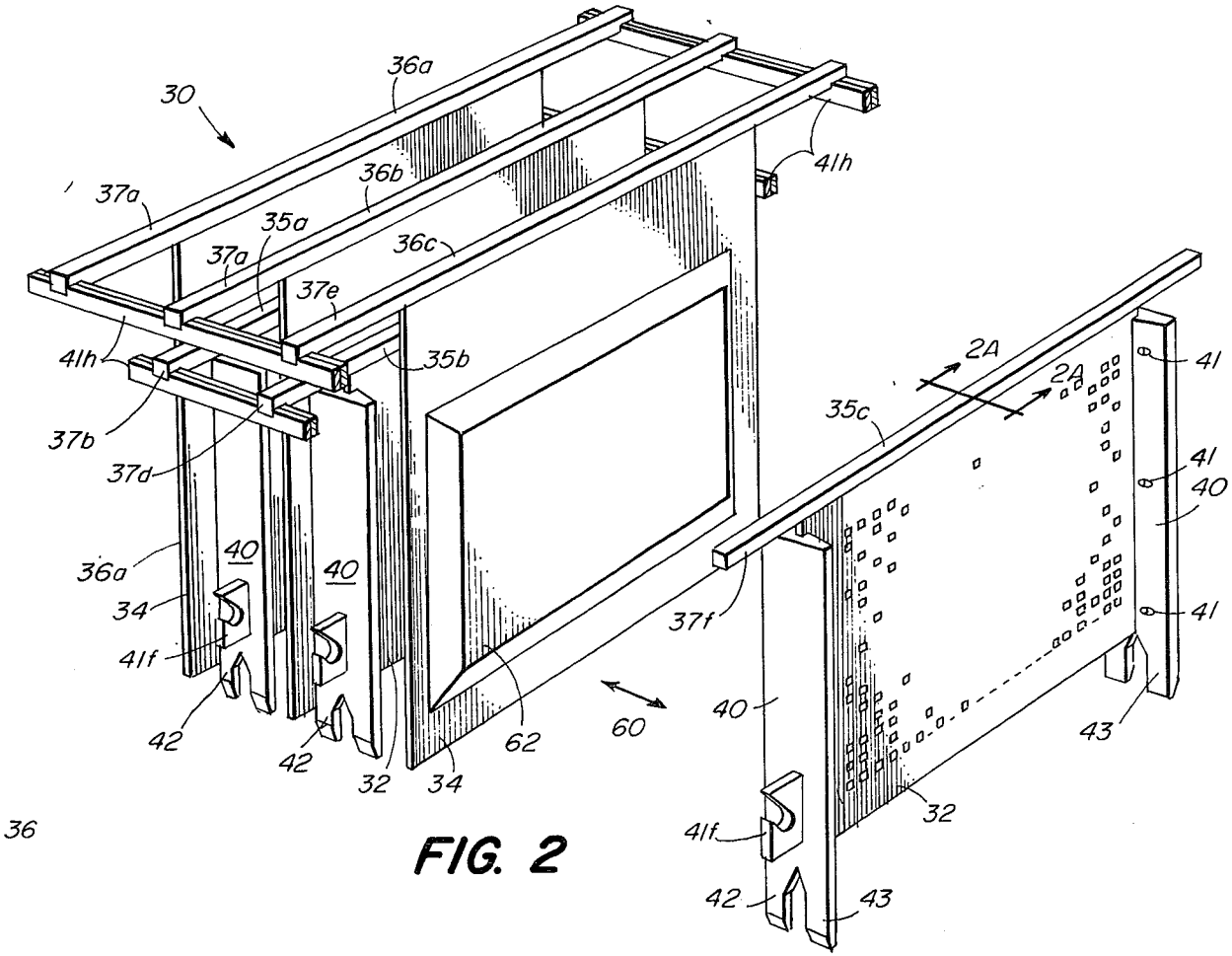
FIG. 2 is a perspective view of the electrode assembly showing the preferred method of removing electrodes from the electrode assembly.

The bottom baffle assembly 14, in its raised or alignment state (FIG. 1), in a position near the top surface of the electrolytic solution, is in position to receive and align with an electrode assembly 30. Electrode assembly 30 comprises a plurality of anodes 32 (FIG. 2) and cathodes 34 arranged in a precise spaced-apart, interleaved, configuration. The anodes and cathodes of the electrode assembly are supported from top edge portions thereof, and, as described in Harvey et al, U.S. Pat. No. 3,875,041, must be carefully and closely spaced from one another to attain the advantages described in the Harvey et al patent of operating at high current densities. The electrode assembly, by the structure to be described, provides that correct spacing for the electrodes.

The Electrode Assembly

Figure 2A:
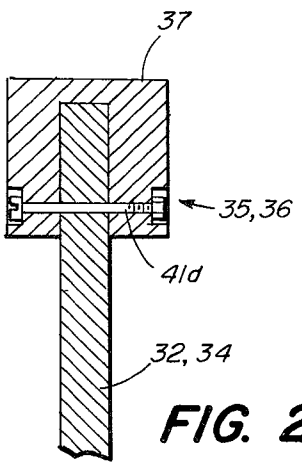
FIG. 2A is a cross-sectional view along lines 2A—2A of FIG. 2.

The anode and cathode electrodes are supported in the interleaved configuration in any convenient manner. In the illustrated embodiment, each anode is supported by a sandwich type structure 35*a*, 35*b*, 35*c*, 35*d*, and each cathode is supported by a separate sandwich structure 36*a*, 36*b*, 36*c*, 36*d*, 36*e*. Each sandwich structure (FIG. 2A) typically comprises a U-shaped conductive bar member 37*a*, 37*b*, . . ., 37*i*, typically copper, in electrical contact with the respective electrodes 32, 34. The sandwich structure is secured by a plurality of stainless steel attachment members 41*d* passing therethrough, to maintain the integrity of the structure. In the electrolytic cell, each bar member rests, due to the force of gravity, on electric power distribution members 38*a*, 38*b* to electrically connect the electrodes to a high current power supply (not shown). When the electrodes are being separated to recover the deposited metal values, (FIG. 2), the electrodes are placed upon walking rails 41*h* which are well known in the art.

Non-conductive convection edge baffles 40, which extend outwardly from either anode side edge portion toward the cathode faces, are attached to the anodes, for example, by pins 41 passing through predrilled holes in the anodes and the baffles. In the completed assembly, each cathode extends outward beyond the edge baffles on either side of the assembly. Therefore, the edge baffles form enclosures between the cathode and anode faces within which sheets of bubbles, provided during operation of the apparatus by the bubble tubes, are guided and constrained in their upward movement. The edge baffles also prevent deposition of metal at the edges of the cathodes which extend beyond the width defined by the baffles.

Figure 3:
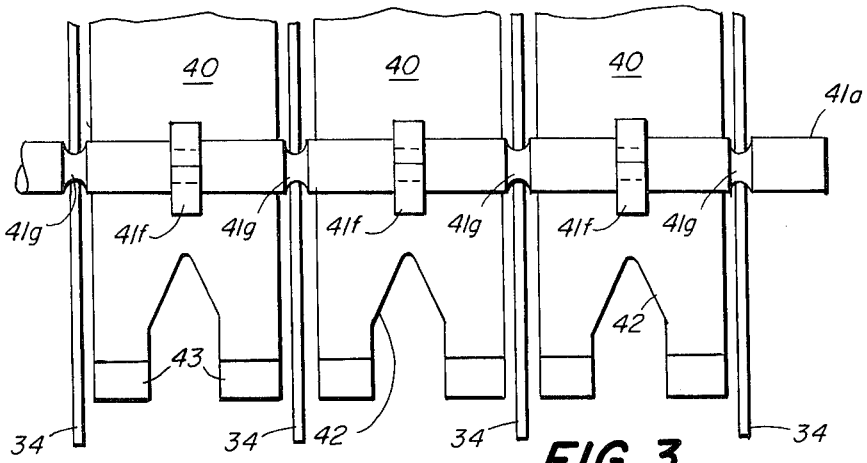
FIG. 3 is a side elevation view of the electrode assembly according to the invention.

In the illustrated embodiment, it is the edge baffles 40 which primarily provide the precise, spaced apart relationship between the cathodes and anodes. In addition, however, bottom locators 41*a* (FIG. 3), one on each side of the electrode assembly, accurately position the bottom of the cathodes with respect to the edge baffles, and hence with respect to the anodes. The bottom locators 41*a* are securely, but releasably, maintained against transverse or lateral movement by slotted channels of outwardly protruding members 41*f* integral with edge baffles 40. The cathodes 34 are held within selectively grooved slots 41*g* to maintain the correct spacing between the anode and cathode faces at the bottom of the electrode assembly.

At the bottom of each illustrated non-conductive convection edge baffle, integral therewith and forming a part thereof, there is provided a position alignment device which is illustrated as a fork-shaped wedge receiving member 42 having a transversely beveled bottom portion 43. In the illustrated embodiment, each edge baffle has both the fork-shaped member 42 and the beveled portions 43. Alternate configurations of the position alignment device may be used, so that, for example, the beveled portions are provided only at the bottom of the edge baffles at either longitudinal end of the assembly. The alignment devices 42, 43 are designed to cooperate with a cooperating positioning means 44, 45 integral with and forming a part of the illustrated anode bottom extensions 19 of the bottom baffle assembly, the alignment devices 42, 43 and positioning means 44, 45 cooperating to align the electrode assembly with the bottom baffle assembly in both a lateral and a transverse direction.

Bottom Baffle Assembly

Figure 4:
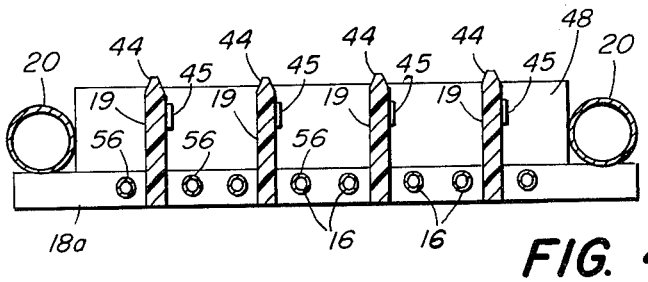
FIG. 4 is a cross-sectional view of the bottom baffle assembly taken along lines 4—4 of FIG. 1.

Referring now to FIGS. 1 and 4, the illustrated bottom baffle assembly comprises the plurality of the bubble tubes 16 in a spaced-apart configuration, the bottom anode extensions 19 being positioned between groups of bubble tubes, and with the flotation tanks 20 at either side of the assembly. The anode extensions each have integral therewith a wedge-shaped upper portion 44 and a thin, angled, transversely directed protrusion 45 which together comprise the cooperating positioning means. As noted above, in the illustrated embodiment, the bottom baffle assembly has two flotation tanks 20, although any other convenient number of tanks can be used to provide adequate flotation for the assembly. (By an appropriate choice of low density materials, the flotation tanks can also be eliminated.) The bottom baffle assembly is integrally connected and supported by vertical support members 48, part of the bubble tube support assembly 18 (FIG. 1).

In other embodiments of the invention, the bottom anode extensions may be secured directly to the anodes and the cooperating positioning means 44, 45 would then exist as independently supported elements on the bottom baffle assembly. In yet other embodiments, the bubble tubes may be provided beneath the bottom anode extensions and perforated in such a manner so that one bubble tube provides the sheets of bubbles on both sides of the extensions.

The bubble tubes 16 are connected, preferably at each transverse end of the bottom baffle assembly, to the gas manifolds 18*a* which are connected to each bubble tube and to gas input terminals 52 through flexible supply conduits 54. Manifolds 18*a* are supported at least in part by support members 48 and are provided at each end of the bubble tubes to provide a more even spatial distribution of pressure and gas flow at the bubble tube orifices 56.

Operation of the Apparatus

The electrode assembly, that is, the assembly comprising the spaced-apart, interleaved cathodes and anodes, is positioned, as a unitary structure, for insertion into the electrolyte, above the bottom baffle assembly. A typical apparatus for supporting the electrode assembly above the vessel 10 comprises a strongback having a plurality of pivotal fingers 57 adjusted to support the electrodes, at opposite ends of the bar members 37, and at the correct interelectrode vertical spacing. The fingers, in the support condition (FIG. 1) are directed normal to the cathode and anode faces. After the electrode assembly is properly positioned, either in the cell or on the walking rails, 41*h*, the fingers pivot in the horizontal plane to a direction parallel to the cathode and anode faces. In this position, a crane used to move the electrode assembly is removed. Strongbacks having these operating characteristics are well known to those skilled in the art.

Figure 5:
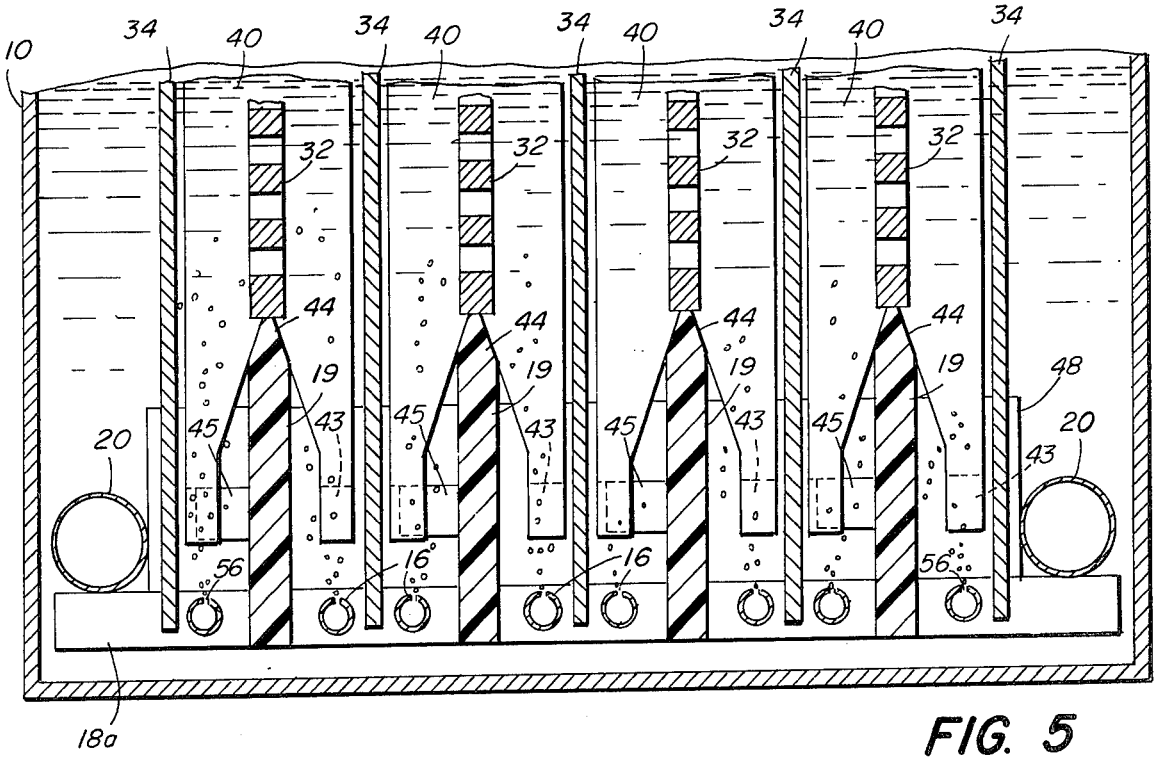
FIG. 5 is a cross-sectional view of the electrode assembly and the bottom baffle assembly submerged in the electrolytic cell.

The bottom baffle assembly, if the electrode assembly is not in positioned contact therewith, is urged upward to its alignment position near the top of the electrolytic surface (FIG. 1). In the alignment position, at least the top portions of the anode extensions extend out of the solution. The electrode assembly is then lowered by the crane into the electrolytic cell whereby each positioning device on the electrode assembly engages a corresponding positioning means on the bottom baffle assembly to accurately align the two assemblies, both laterally and transversely, thereby properly spacing the anodes and cathodes with respect to each other and, in the illustrated embodiment, positioning a bubble tube between each anode extension and a nearest cathode face. The electrode assembly is thereafter lowered into a submerged condition in the vessel 10 (FIG. 5); and as the electrode assembly is lowered, the bottom baffle assembly is forced down toward its submerged state close to or at the bottom of the electrolytic cell. When the electrode support assembly is in its fully submerged position, with the cathodes and anodes fully submerged in the electrolytic solution, (and correspondingly, with the bottom baffle assembly in its submerged state), the system is ready to begin the electrodeposition procedure described in the Harvey et al. patents.

Thus the procedures described in the Harvey et al. patents have been followed to the extent that, for example, the bottom extensions 19 are aligned with the anodes and extend downward from the bottom of anodes 32 when the electrode assembly is in its submerged position in the electrolytic cell. The anode bottom extensions in combination with the submerged length of the cathodes thereby prevent deposition of metal values at the bottom edge portions of the cathode faces. (This interrelationship between the anodes, cathodes, and anode bottom extensions is fully discussed in the Harvey et al patents referred to above.)

Just prior to applying the electrodeposition current, gas input terminals 52 supply water saturated air to flexible supply conduits 54 whereby sheets of air bubbles are provided between the cathode and anode faces. Electrodeposition then begins as high density electric currents pass between anode and cathode electrodes. The detailed procedure for controlling the deposition process is detailed in the Harvey et al U.S. patents referred to above and incorporated herein by reference.

After a predetermined quantity of metal values are deposited on the cathodes, the electrode assembly is lifted by the crane, as a unitary structure, and removed from the electrolytic solution and cell and is placed on walking rails **41*h* (FIG. 2**) for later electrode separation and metal value removal. As the electrode assembly is lifted and removed from the cell, the bottom baffle assembly rises to its alignment position near the surface of the electrolyte.

Referring again to FIG. 2, the anode and cathode plates are separated using a horizontally directed pulling motion as indicated by arrows 60 so that the electrodes are, at worst, subjected to compression forces only. This differs significantly from the earlier versions of this general class of equipment, (whether or not gas agitation is used), in which the metal containing cathodes only were lifted from the electrolytic cell by a vertically directed pulling motion. Each cathode, according to the earlier process, is pulled vertically out of the electrolytic cell assembly, leaving the anodes in place, and thereby subjecting the electrodes and baffles to significant, and potentially damaging, shear forces. Thus, according to the invention, the electrodes, when removed with a horizontally directed pulling motion, are less likely to be damaged or cause damage during the separation step.

After the electrodes are separated and the metal values 62 are removed from the cathode faces (as is well known in the art), the electrodes are reassembled, again using the horizontally directed motion, and are reinserted into the electrolytic cell in alignment with the bottom baffle assembly, as described above, for continued deposition of metal values from the electrolytic solution.

Other embodiments of the invention including additions, subtractions, deletions, and other modifications of the preferred embodiment will be obvious to those skilled in the art and are within the scope of the following claims.

What is claimed is:

1. In an electrodeposition cell for depositing metal values from an electrolyte, the cell comprising an electrode assembly having a plurality of anodes and cathodes, spaced apart in an interleaved configuration, for submergence in the electrolyte, non-conductive anode bottom extensions positioned beneath the anodes, non-conductive convection edge baffles positioned adjacent to opposite vertical edges of the anode faces and extending toward the cathode faces, the cathodes having a submerged length being greater than the submerged length of the anodes and the cathodes being wider than the anodes so that the vertical edge portions of the cathodes extend outwardly beyond the convection baffles, means for maintaining a close spacing between the interleaved anode and cathode faces, and bubble tubes having orifices for generating sheets of relatively small, rapidly ascending bubbles of gas that result in agitation of the electrolyte over the cathode faces, the portion of each bubble tube having the orifices being positioned to provide said sheets of bubbles between the non-conductive anode extensions and the cathode faces, the baffles forming enclosures between the cathode and anode faces which minimize lateral spreading and contraction of the sheets of bubbles and preventing deposition of metal at the edge portions of the cathodes extending beyond the baffles, and the anode bottom extensions, in combination with the submerged length of the cathodes, preventing deposition of metal at bottom edge portions of the cathode faces, the improvement comprising a bottom baffle assembly having a tube support assembly for positioning said bubble tubes in a spaced apart relationship, said support assembly and said bubble tubes together forming an integral structure, at least one flexible conduit for supplying gas to said bubble tubes, means for urging said bottom baffle assembly to a position near the electrolyte surface, said electrode assembly having an electrode baffle means for engaging the baffle assembly for aligning the electrode assembly and the baffle assembly, and for maintaining said baffle assembly in a submerged state when said anodes and cathodes are submerged, whereby when said anodes and cathodes are removed, as a unit, from said electrodeposition cell, said baffle assembly rises from the submerged state to an alignment state near the top of said electrodeposition solution.

2. The cell of claim 1 wherein said electrode baffle means includes said edge baffles and a position alignment device integral with said edge baffles, and said bottom baffle assembly further comprises a cooperating positioning means integral with said baffle assembly for receiving said position alignment device, whereby when said electrode assembly, having said anodes and cathodes, is placed into said cell, said position alignment device engages said cooperating positioning means to provide a selected spaced apart aligned relationship between said anode and cathode faces and said bubble tubes, and said baffle assembly is urged into said submerged state.

3. The cell of claim 1 further including a stop means for preventing the baffle assembly from rising beyond a selected cell level.

4. The cell of claim 2 wherein said bottom baffle assembly further comprises said bottom anode extensions and the positioning means comprises a plurality of locating wedges, each wedge formed at a top edge portion of a said anode extension and protruding at least slightly above the surface of the electrolyte when the bottom baffle assembly is in its alignment state and wherein said position alignment device comprises a plurality of fork-shaped wedge receiving members, each member being integral with and forming the bottom portion of a said edge baffle.

5. The cell of claim 1 further comprising a bottom electrode alignment means for aligning the bottom of said anodes and cathodes in said spaced apart relationship, said alignment means positively and releasably engaging said anode edge baffles and said cathodes.

6. The cell of claim 1 wherein said bottom baffle assembly has a net positive buoyancy at least when the bubble tubes are filled with gas.

7. The cell of claim 6 wherein said bottom baffle assembly further comprises at least one flotation tank for providing the positive buoyancy to said baffle assembly.

8. In an electrowinning cell comprising insoluble anodes for submergence in an electrolyte, non-conductive anode bottom extensions positioned beneath the anodes, cathodes, closely spaced apart from and interleaved with, the anodes, non-conductive convection edge baffles attached to opposite vertical edges of the anode faces and extending toward the cathode faces, the cathodes having a submerged length greater than the submerged length of the anodes, and the cathodes being wider than the anodes so that edge portions of the cathodes extend outwardly beyond the convection baffles, means for maintaining close spacing between the interleaved anode-cathode faces, and bubble tubes having orifices for generating sheets of relatively small rapidly ascending bubbles of gas that result in agitation of the electrolyte over the cathode faces, the portion of each bubble tube having the orifices being positioned to provide said sheets of bubbles between respective non-conductive anode extensions and the cathode faces so that each sheet of bubbles sweeps across a cathode face, the baffles forming enclosures between the cathode and anode faces which minimize lateral spreading and contraction of the sheets of bubbles and prevent deposition of metal at edge portions of the cathodes extending beyond the baffles, said anode bottom extensions in combination with the submerged length of the cathodes preventing deposition of metal at the bottom of the cathode faces, and said means for maintaining close spacing, said bubble tubes, and said baffles, providing an electrolyte convection system which enables the efficient use of high current densities in an electrodeposition process, the improvement comprising a bottom baffle assembly having a tube support assembly for positioning said bubble tubes in a spaced apart relationship, said support assembly and said bubble tubes together forming an integral structure, flexible tubular means for supplying gas to said bubble tubes, means for urging said bottom baffle assembly to a position near the electrolyte surface, an electrode assembly comprising said anodes and cathodes, further having an electrode baffle means for engaging the baffle assembly, for aligning the electrode assembly and the baffle assembly, and for maintaining the baffle assembly in a submerged condition when said electrode assembly is submerged, whereby when said anodes and cathodes are removed from said electrowinning cell as a unit, said bottom baffle assembly rises from a submerged state to an alignment state near the top of said electrolytic solution.

9. The electrowinning cell of claim 8 wherein said electrode baffle means includes said edge baffles, and a position alignment device integral with said edge baffles, and said bottom baffle assembly further comprises a cooperating positioning means integral with said baffle assembly for receiving said position alignment device, whereby when said electrode assembly is placed into said cell, said position alignment device engages said cooperating positioning means to provide a selected alignment relationship between the anode and cathode faces and said baffle assembly, and to urge said baffle assembly to said submerged state.

10. The electrowinning cell of claim 9 further including a stop means for preventing the baffle assembly from rising beyond a selected cell level.

11. The electrowinning cell of claim 9 wherein said bottom baffle assembly further comprises said bottom anode extensions and the positioning means comprises a plurality of locating wedges, each wedge formed at a top edge portion of a said anode extension and protruding at least slightly above the surface of the electrolyte when the bottom baffle assembly is in its alignment state, and wherein said position alignment device comprises a plurality of fork-shaped wedge receiving members, each member being integral with and forming the bottom portion of a said edge baffle.

12. The electrowinning cell of claim 8 further including bottom electrode alignment means for aligning the bottoms of said electrodes in said spaced apart relationship, said alignment means positively and releasably engaging said anode edge baffles and said cathodes.

13. The electrowinning cell of claim 8 wherein said bottom baffle assembly has a net positive buoyancy at least when the bubble tubes are filled with gas.

14. The electrowinning cell of claim 13 wherein said bottom baffle assembly further comprises at least one flotation tank for providing said net positive buoyancy to said baffle assembly.

15. A method of performing electrodeposition at a high ratio of current density to metal ion concentration in a cell which includes anodes, cathodes, and an electrolyte with the attendant production of high quality metal which can be easily stripped from the cathodes, comprising the steps of:

positioning non-conductive convection edge baffles adjacent to opposite edges of the anode faces so as to extend toward the cathode faces, providing cathodes that extend downwardly to a level below the bottom edge of the anodes, and that are wider than the anodes so that the edges of the cathodes extend outwardly beyond the convection edge baffles, assembling said cathodes, anodes, and edge baffles to form an electrode assembly of spaced apart, interleaved cathodes and anodes, whereby said opposed anode and cathode faces are spaced apart from each other at a distance of less than about two inches, providing a bottom baffle assembly to mate and align with the electrode assembly, said baffle assembly having bubble tubes spaced apart in an integral relationship thereto, providing an upward force, acting on said bottom baffle assembly, urging said assembly to rise to an alignment state near the top of said electrolyte, aligning said electrode assembly, having interleaved cathodes and anodes, with said baffle assembly as the electrode assembly is placed, as a unitary structure, into the electrolyte, and submerging said electrode assembly below the surface of the electrolyte, whereby said bottom baffle assembly is submerged, the bubble tubes are positionally aligned with non-conductive anode extensions and the cathode faces, and the non-conductive anode bottom extensions are positioned beneath the anodes, supplying gas to said bubble tubes through at least one flexible conduit, and electrodepositing metal on the cathodes while generating sheets of gas bubbles from the bubble tubes, each sheet passing through the electrolyte between opposed anode-cathode faces to produce agitation of the electrolyte over the cathode faces as metal is being deposited thereon and maintaining the convection edge baffles during electrodeposition to form enclosures between the anode and cathode faces to minimize lateral spreading and contraction of the sheets of bubbles and to prevent deposition of metal at edges of the cathodes extending beyond the baffles, and preventing electrodeposition on the bottom of the cathode faces by the combination of the submerged length of the cathodes and the anode bottom extensions.

16. The method of claim 12 further including the steps of lifting said electrode assembly, including said cathodes and said anodes, as a unitary structure, from said electrolyte solution, separating said cathodes and said anodes from each other, removing deposited metal from said cathode faces, reassembling said cathodes and anodes to form said electrode assembly, and reinserting said reassembled electrode assembly as a unitary structure into said electrolyte in alignment with said bubble tubes.

17. The method of claim 16 including the steps of allowing said bottom baffle assembly to rise to a position near the electrolyte surface when the electrode assembly is removed from the electrolyte, at which position at least a portion of said bottom baffle assembly extends above the upper surface of said electrolyte, and providing cooperating alignment aids on said bottom baffle assembly and said electrode assembly to align said assemblies in said reinsertion step.

18. The method of claim 16 wherein said separating step includes the steps of horizontally separating said anodes and said cathodes along an axis normal to their faces whereby the physical integrity of said anodes and cathodes is maintained.

19. A method of electrowinning metal at a high ratio of current density to metal ion concentration in a cell which includes insoluble anodes, cathodes, and an electrolyte with the attendant production of high quality metal which can be easily stripped from the cathodes, comprising the steps of attaching non-conductive convection edge baffles to opposite vertical edges of the anode faces so as to extend toward the cathode faces, positioning non-conductive anode bottom extensions beneath the anodes, providing cathodes that are wider than the anodes, the edges of the cathodes extending outwardly beyond the convection edge baffles, providing said cathodes with a submerged length which is greater than the submerged length of the anodes, forming an electrode assembly of said cathodes, anodes, and convection edge baffles, said cathodes and anodes being interleaved with opposed anodes and cathodes being spaced apart from each other at a distance less than about two inches, and said assembly being inserted into or removed from said cell as a unitary structure, positioning a bottom baffle assembly in said cell, said bottom baffle assembly having bubble tubes spaced apart in an integral relationship thereto, urging said bottom baffle assembly in an upward direction, providing said bubble tubes with gas through at least one flexible line, aligning said electrode assembly with said baffle assembly as the electrode assembly is placed, as a unitary structure, into the electrolyte, and submerging the electrode assembly below the surface of the electrolyte, whereby the bottom baffle assembly is submerged and said bubble tubes are positionally aligned with the non-conductive anode extensions and the cathode faces, electrodepositing metal on the cathodes while generating sheets of gas bubbles from the bubble tubes through the electrolyte between opposed anode-cathode faces, said gas sheets producing agitation of the electrolyte over the cathode faces as metal is being deposited thereon and maintaining said convection edge baffles during electrodeposition to form enclosures between cathode and anode faces to minimize lateral spreading and contraction of the sheets of bubbles and to prevent deposition of metal at the edges of the cathodes extending beyond the baffles, and maintaining said bottom edge of said cathode faces far enough below said anodes to prevent deposition of metal at said cathode bottom face edges.

20. The electrowinning method of claim 19 further including the steps of lifting said electrode assembly, including said cathodes and said anodes, as a unitary structure, from said electrolyte, separating said cathodes and said anodes from each other, removing deposited metal from said cathodes, reassembling said cathodes and anodes to form said electrode assembly, and reinserting said reassembled electrode assembly, as a unitary structure, into said electrolyte in alignment with said bubble tubes.

21. The electrowinning method of claim 19 including the steps of allowing said bottom baffle assembly to rise to a position near the electrolyte surface when the electrode assembly is removed from the electrolyte, at which position at least a portion of said bottom baffle assembly extends above the upper surface of said electrolyte, and providing cooperating alignment aids integral with said bottom baffle assembly and said electrode assembly to align said assemblies during said reinsertion step.

22. The electrowinning method of claim 19 wherein said separating step includes the step of horizontally separating said anodes and said cathodes along an axis normal to their faces, whereby the physical integrity of said anodes and cathodes is maintained.

* * * * *